United States Patent [19]

Dürr

[11] Patent Number: 4,592,257

[45] Date of Patent: Jun. 3, 1986

[54] HAND-HELD SCREW DRIVING DEVICE WITH ADJUSTABLE DEPTH STOP

[75] Inventor: Paul Dürr, Ulisbach, Switzerland

[73] Assignee: Hilti Aktiengesellschaft, Furstentum, Liechtenstein

[21] Appl. No.: 776,993

[22] Filed: Sep. 16, 1985

Related U.S. Application Data

[63] Continuation of Ser. No. 552,487, Nov. 16, 1983, abandoned.

[30] Foreign Application Priority Data

Nov. 19, 1982 [DE] Fed. Rep. of Germany ..... 3242862

[51] Int. Cl.[4] ..... B25B 23/00

[52] U.S. Cl. ..... 81/429; 408/202

[58] Field of Search ..... 81/429; 408/239 R, 241 R, 408/241 S, 202; 279/1 K; 173/48, 20, 21

[56] References Cited

U.S. PATENT DOCUMENTS

| | | | |
|---|---|---|---|
| 2,790,471 | 4/1957 | Graybill | 81/429 |
| 2,940,488 | 6/1960 | Riley, Jr. | 81/429 |
| 3,454,059 | 7/1969 | Sindelar | 81/429 |
| 3,460,408 | 8/1969 | Raymond | 408/112 |
| 3,800,839 | 4/1974 | Bogle et al. | 81/429 |
| 3,934,629 | 1/1976 | Boman | 81/429 |
| 4,237,946 | 12/1980 | Leitner | 81/429 |

FOREIGN PATENT DOCUMENTS 2220792 10/1981 Fed. Rep. of Germany .

*Primary Examiner*—Donald R. Schran
*Assistant Examiner*—James L. Wolfe
*Attorney, Agent, or Firm*—Toren, McGeady, Stanger, Goldberg & Kiel

[57] ABSTRACT

A hand-held device for driving screws into a receiving member or material includes a housing and an axially extending depth stop mounted on the front end of the housing. The depth stop is adjusted in the axial direction relative to the housing by an actuating sleeve which encircles a part of the depth stop and of the housing. The sleeve is connected to the depth stop by a pin and is axially movable between a first position where it is fixed to the housing and a second position where it is rotatable relative to the housing. Catch elements on the actuating sleeve and the housing hold the actuating sleeve in the first position. In the first position the pin fixes the actuating sleeve against rotation relative to the housing.

10 Claims, 4 Drawing Figures

HAND-HELD SCREW DRIVING DEVICE WITH ADJUSTABLE DEPTH STOP

This is a continuation of application Ser. No. 552,487, filed Nov. 16, 1983 now abandoned.

SUMMARY OF THE INVENTION

The present invention is directed to a hand-held device used, in particular, for driving screws into a receiving member or material. The device includes a housing and a depth stop adjustable relative to the housing. The depth stop is connected to the housing by an adjustable thread connection and an actuating sleeve. The actuating sleeve adjusts the position of the depth stop. The actuating sleeve is axially displaceable relative to the depth stop and in one axially displaced position the sleeve is connected to the housing so that it can not be rotated relative to the housing.

There are known devices of the above type which are used, in particular, for driving in screws and they are equipped with an adjustable depth stop. Such a depth stop is usually a sleeve which includes an insert acting on the screw to be driven in. It has been known to adapt the insert and the depth stop to one another so that the driving in process is terminated when the stop contacts the receiving member or material into which the screw is to be driven. Termination of the driving action is effected by coupling elements in the device which interrupt the application of torque to the insert when the depth stop experiences a sufficient contact with the receiving member. As a result, the position of the depth stop ultimately has a direct influence on the depth to which the screw is inserted.

Based on the particular application and the type of screw to be used, the depth to which the screw is inserted must be adjustable and adjustable depth stops have been known for this purpose. Since the insert, which delivers torque to the screw so that it can be driven in, is a part arranged in a fixed position in the device, it is common to adjust the depth stop relative to the insert and, in turn, relative to the device.

Such an adjustable depth stop is known, as disclosed in German Pat. No. 22 20 792. This known depth stop involves a sleeve connected with the housing by an adjusting thread. To adjust the depth stop in the axial direction, the depth stop is turned by the actuating sleeve connected to it so that the depth stop is not rotatable relative to the sleeve and is axially displaceable relative to it. To ensure that the depth stop does not move from its preselected position, as may be caused by vibrations, careless handling and the like, the actuating sleeve is fixed to the housing so that it is not rotatable relative to the housing. Accordingly, a spring is provided which biases the actuating sleeve against the end face of the housing, where cams and openings provided for this purpose, cooperate with one another.

This known device is especially disadvantageous. For instance, it is necessary for the operator to pull the actuating sleeve away from the housing and at the same time to rotate it. Such movement, which must be performed in two steps, is extremely bothersome. Further, there is the considerable danger that the actuating sleeve may be accidentally pulled away from the housing and rotated, such as by inexpert handling by the operator. The known cams and recesses for securing the actuating sleeve at the housing have a disadvantageous effect in that only a small number of fixing positions are available for positioning the actuating sleeve so that it does not rotate. As a result, fine adjustment of the depth stop is not possible. Moreover, external grooves which afford a certain amount of accuracy in establishing a sufficiently exact adjustment, are located at the depth stop for the connection between the actuating sleeve and the depth stop. While the connection does not permit relative rotation it allows axial displacement. Since these parts are exposed to extremely heavy soiling, the proper operability of the device is in question.

Therefore, the primary object of the present invention is to provide a hand-held device of the type mentioned above which includes a depth stop not susceptible to operational disturbances and which is simple to use and can be secured against any accidental adjustment despite the ability to provide fine adjustment.

In accordance with the present invention, catch elements are arranged for securing the actuating sleeve at the housing so that the sleeve can not rotate relative to the housing. When the catch elements are disengaged the actuating sleeve can be moved axially into another position where it is freely rotatable relative to the housing.

As in the known devices, the depth stop is rotatable relative to the housing by means of the actuating sleeve due to the solution afforded by the present invention. The adjusting thread permits the depth stop to be moved into different axial positions by rotating the stop and the actuating sleeve. The connection between the actuating sleeve and the depth stop permits axial displacement of the sleeve relative to the stop so that, as in the known solution, it is arranged so that when the sleeve is displaced axially from the housing the combined rotation of the two parts is possible and when the sleeve is displaced axially toward the housing it is secured so that it can not be rotated relative to the housing.

In accordance with the present invention, the catch elements or members afford the possibility to locate the actuating sleeve in one position where it can rotate relative to the housing and in another position where it is secured to the housing so that it can not rotate relative to it. Since the connection or engagement afforded by the catch elements requires a certain amount of force to be applied by the user to disengage the elements, it is ensured that the securement of the sleeve at the housing can not be accidentally released permitting the depth stop to be moved. Further, it is assured that after axial displacement of the actuating sleeve from the housing, the adjustment of the depth stop can be carried out without any difficulty merely by rotating the depth stop.

A variety of elements, known per se, can be used as the catch elements, such as spring-loaded balls, resilient fingers and the like. With regard to economy and assembly of the device in a preferred embodiment, one of the catch elements is a spring ring, while another is a shoulder cooperating with the ring so that it is possible to retain the spring ring on an extension of the housing with an inwardly directed shoulder on the actuating sleeve which extends for the full amount of or only a portion of the circumference of the sleeve.

Another feature of the invention is the provision of a securing pin mounted in the actuating sleeve. The pin carries out two functions of the sleeve. One function ensures the securement of the actuating sleeve to the housing so that there is no relative rotation between the two parts and the other function is to interconnect the sleeve and the depth stop so that there is no relative rotation between them while relative axial displacement is possible. Such a securing pin can be fixed to the interior of the actuating sleeve. In this position the pin is completely protected against any mechanical damage as well as against becoming soiled so that it can fulfill completely the required functions of the actuating sleeve.

Preferably, the securing pin is fastened to a projection on the interior of the actuating sleeve so that it has two free ends. While it is preferable to form the actuating sleeve of a plastics material, the securing pin can be formed of metal and can be fixed in a cam formed in the interior of the sleeve.

When the securing pin is positioned as mentioned above, one of its free ends which faces the housing can serve to fix the sleeve with the housing so that there is no relative rotation between them. Further, recesses in the form of slots, holes or the like, can be provided on the housing into which the end of the securing pin engages. The cooperation between the securing pin and the recesses in the housing afford a sufficiently fine adjustment of the depth stop. The recesses can be formed directly in the housing or, in a simple arrangement, a separate member in the form of a ring with the recesses arranged in it can be secured to the housing or to an extension of the housing.

The other free end of the securing pin serves to interconnect the actuating sleeve and the depth stop so that there is no relative rotation between the parts but relative axial displacement is possible. Accordingly, this other free end of the pin engages, in every position of the actuating sleeve, in a borehole in the depth stop to provide the required interconnection. The unimpeded use of the complete adjusting path of the depth stop can be attained by providing the borehole with a sufficient depth.

To prevent any damage after traversing the full adjusting path of the depth stop toward the housing which might occur if the stop becomes jammed in the housing, a lock is provided which interrupts the rotation of the depth stop along with the actuating sleeve. Such a rotation lock is provided by an extension on the housing which cooperates with a cam on the adjacent end of the depth stop as soon as the stop is moved into its final position toward the housing.

It has been noted that the end face as well as the adjoining surfaces of the depth stop are exposed to particularly heavy wear. Such wear is especially great when the depth stop is formed, for reasons of weight, of plastics material. In a great number of instances, the wear is such that the depth stop must be replaced. Since the depth stop includes the adjusting thread as well as the surfaces for receiving the actuating sleeve, the stop can be a very expensive element.

Accordingly, another feature of the invention is to form the depth stop in two parts, one a simple stop sleeve and the other a threaded bush on which the adjusting thread is formed. These two parts are secured together. A bayonet connection, which is well known, has proved to be advantageous for connecting the two parts of the depth stop together. Such a connection has considerable advantages in providing accuracy in the interengagement of the parts, ease in the disassembly of the parts and savings in the costs. Further, substantial advantages are achieved in the production of the device if the stop sleeve and the threaded bush are formed of a plastics material.

The division of the depth stop into two parts is of particular interest with regard to costs, since only the simpler part which requires replacement is exposed to wear. In contrast, the more expensive part does not need to be replaced.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
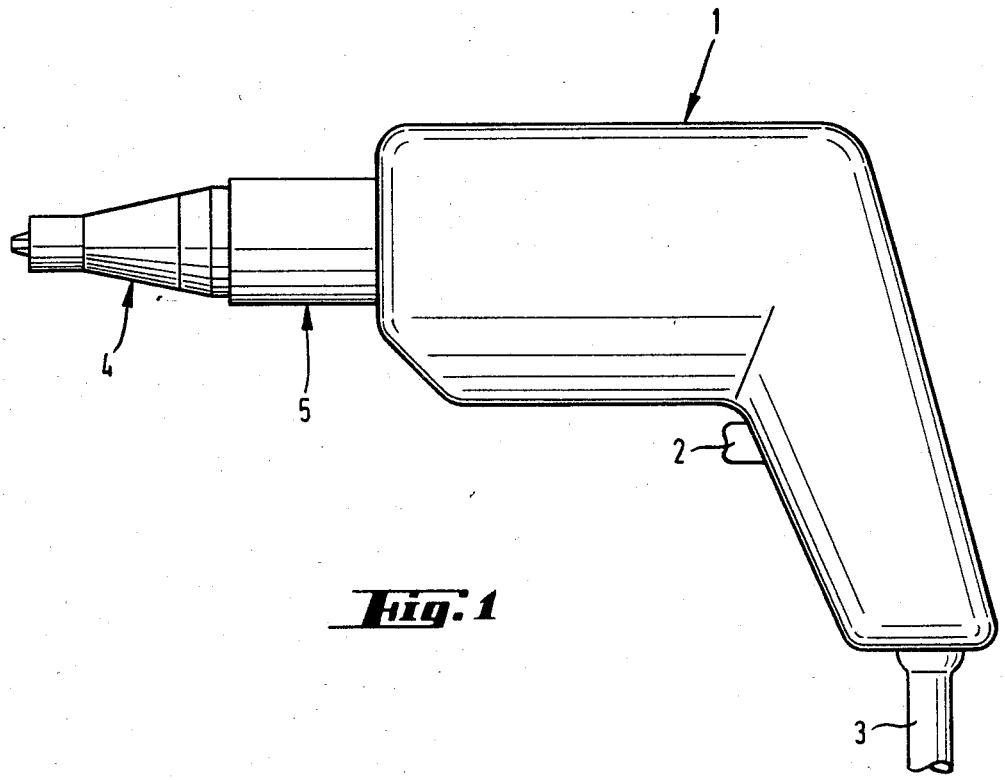
FIG. 1 is a side elevational view of a device embodying the present invention.

In FIG. 1 a full side view of a hand-held device for driving screws into a receiving member or material is shown. The device includes a housing 1 with a front end at the left and a rear end at the right. The housing 1 is shaped to provide a downwardly extending handle as viewed in FIG. 1 with an actuating switch 2 for operating the device and a cable 3 for supplying electric power to a motor, not shown. At the front end of the housing 1 there is a depth stop 4 encircled for a portion of its axial length by an actuating sleeve 5 with the rear end of the sleeve located adjacent to the main portion of the housing 1.

Figure 4:
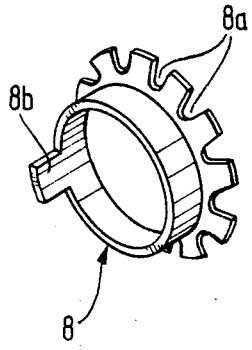
FIG. 4 is a perspective view of a part of the device shown in FIGS. 2 and 3.
Figure 2:
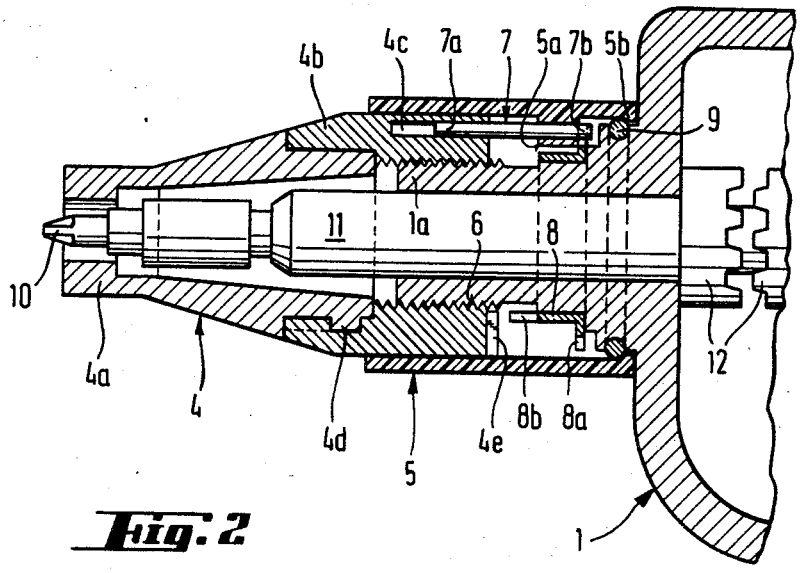
FIG. 2 is a partial sectional view of the front end of the device shown in FIG. 1 with the actuating sleeve fixed relative to the housing.
Figure 3:
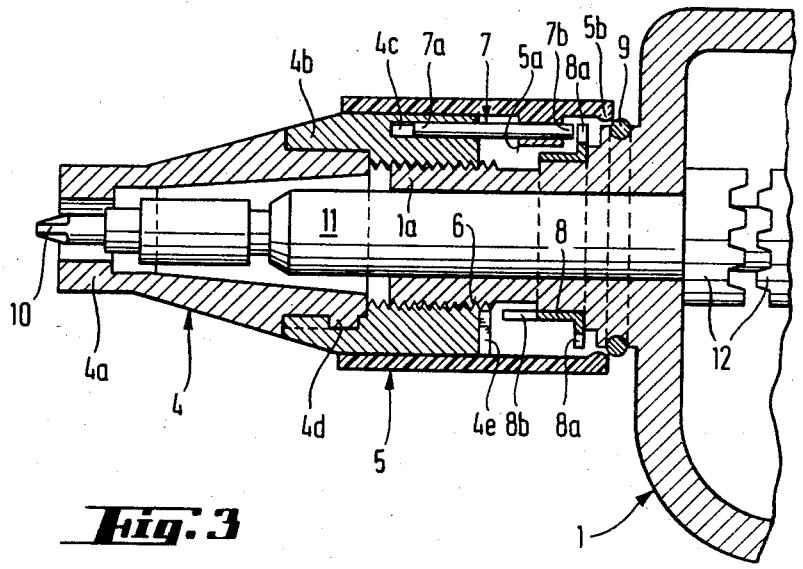
FIG. 3 is a view similar to FIG. 2, however, with the actuating sleeve being freely rotatable relative to the housing.

As illustrated in FIGS. 2 and 3, the depth stop 4 is interengaged with an extension 1*a* on the front end of the housing 1 by an adjusting thread connection 6 formed by an axially extending thread on the interior of the depth stop and a corresponding axially extending thread on the outside surface of the extension 1*a*. Actuating sleeve 5 is connected to the depth stop 4 so that it can not rotate but is axially displaceable relative to the stop. A securing pin 7, fixed to an inwardly directed projection 5*a* on the inner surface of the sleeve, serves to connect the sleeve and the depth stop 4. The securing pin 7 extends forwardly and rearwardly from the projection 5*a* so that, as can be seen in the drawing, one end 7*a* of the securing pin 7 fits into a blind borehole 4*c* in the rear end of the depth stop 4. Borehole 4*c* is dimensioned, in the axial direction of the device, so that the securing pin can be moved relative to the depth stop the distance required to accommodate the axial displacement of the actuating sleeve 5 relative to the depth stop 4. As viewed in the drawing, particularly FIGS. 2 and 3, the axial driving direction of the device is the same as the axial direction of the depth stop 4 and the actuating sleeve 5. A locking ring 8 is fixed securely on the axially extending extension 1*a* at the front end of the housing 1. Ring 8, note the perspective showing in FIG. 4, has an axially extending sleeve portion with a flange extending radially outwardly from the rear end of the sleeve portion. A plurality of recesses 8*a* are formed in the flange spaced apart in the circumferential direction of the ring 8. The recesses 8*a* are distributed around the circumference of the locking ring 8 to afford a sufficiently fine adjustment of the depth stop 4. The recesses 8*a* are dimensioned to receive the rear end 7*b* of the securing pin 7. When the securing pin 7 is in the position shown in FIG. 2, the rear end 7*b* projects into one of the recesses 8*a* on the locking ring 8 fixing the actuating sleeve 5 so that it can not be rotated relative to the housing 1.

In FIG. 3 the securing pin 7 is displaced axially forwardly of the locking ring 8 so that it no longer engages one of the recesses 8*a*. Accordingly, in the position in FIG. 3, the sleeve 5 can be rotated relative to the housing 1. As mentioned above, the arrangement of the recesses 8*a* in the locking ring 8 affords an economical solution for the provision of the recesses in the housing 1. It would also be possible in an alternative arrangement to form the recesses directly in the extension 1*a* of the housing 1.

Adjacent the juncture of the extension 1*a* with the main body of the housing 1 there is a spring ring 9 fitted into the extension. The spring ring 9 secures the actuating sleeve 5 against axial displacement relative to the housing. In the position of the device shown in FIG. 2, a shoulder 5*b*, on the inside of the actuating sleeve 5 at its rear end, fits behind the spring ring 9 and prevents axial movement of the sleeve relative to the housing. The combination of the shoulder 5*b* and the spring ring 9 forms a catch or locking device for the actuating sleeve 5 and the housing 1.

An insert 10, known per se and not forming a part of the present invention, can be seen best in FIGS. 2 and 3 and is shaped to interfit with Phillips-head screws. Insert 10 is fitted into a shaft 11 which is connectible with the drive unit, not shown, of the device by a claw clutch 12, also known per se, with the clutch engagement achieved by overcoming the force of a spring, not shown. As in all known devices of this type, torque is transmitted to the insert 10 as long as the depth stop 4, that is the front end of the depth stop or left-hand end as viewed in FIGS. 2 and 3, does not contact the surface of the receiving member or material into which the screw is being driven. After such contact takes place, the insert 10 can be displaced relative to the depth stop 4 so that the connection with the drive unit over the clutch 12 is interrupted and the transmission of torque to the insert 10 is terminated.

As is displayed in FIGS. 2 and 3, the depth stop 4 is made up of two parts, one a stop sleeve 4*a*, which forms the front end of the depth stop and a threaded bush 4*b* which provides the threaded interconnection between the projection 1*a* on the housing 1 and the depth stop. A bayonet connection 4*d*, known per se, is shown in a general manner in FIGS. 2 and 3, and serves to connect the stop sleeve and the bush.

As can be appreciated from the above description, the axial adjustment of the depth stop 4 is effected by moving the actuating sleeve axially from the position shown in FIG. 2 into that displayed in FIG. 3. When an axially directed force is applied to the actuating sleeve 5 so that the locking engagement between the shoulder 5*b* and the spring ring 9 is broken, the sleeve can be moved axially over the outside surface of the bush 4*b*. In the position shown in FIG. 3, the actuating sleeve 5 is freely rotatable relative to the housing 1. In this rotational position of the actuating sleeve 5, due to the interconnection between the sleeve and the depth stop 4 afforded by the securing pin 7, the depth stop can also be rotated. Because of the threaded interconnection 6 between the depth stop and the extension 1*a* of the housing 1, the depth stop experiences an axial displacement relative to the housing 1 as well as relative to the actuating sleeve 5. When the desired position of the depth stop 4 is achieved, the actuating sleeve 5 is moved in the axial direction toward the rear end of the housing 1 so that the rear end 7*b* of the securing pin 7 slides into one of the recesses 8*a* in the locking ring 8 and provides the engagement between the sleeve and the housing so that there is no relative rotational movement between them. Similarly, since the actuating sleeve can not be rotated, it is not possible to rotate the depth stop 4 relative to the housing 1. This position of the actuating sleeve 5, secured against rotation relative to the housing 1, is shown in FIG. 2 with the shoulder 5*b* on the inner surface at the rear end of the actuating sleeve 5 moved over the spring ring 9 so that the actuating sleeve is secured against any axial displacement in this position.

To assure that no damage occurs due to excessive rotation of the actuating sleeve 5 when the depth stop 4 is displaced toward the main body of the housing 1, a rotation lock is provided consisting of a cam 4*e* arranged at the rear end of the bush 4*b* of the depth stop 4 and an extension 8*b* on the locking ring 8. The extension 8*b* is shown in FIGS. 2 and 3 as well as in FIG. 4. When the depth stop 4 has moved axially for the full extent toward the main body of the housing 1, the cam 4*e* strikes against the extension 8*b* on the locking ring 8. Since the locking ring 8 is rigidly connected to the housing 1, the extension 8*b* forms a fixed stop on the housing 1. Since the two parts, that is the cam 4*e* and the extension 8*b*, contact one another on only radially extending surfaces rather than running axially against one another, the parts do not become jammed due to the lead of the threaded interconnection 6.

While specific embodiments of the invention have been shown and described in detail to illustrate the application of the inventive principles, it will be understood that the invention may be embodied otherwise without departing from such principles.

I claim:

1. Hand-held device for driving screws into a receiving member or material comprising a housing having a front end and an opposite rear end with the axial driving direction of the screw being in the rear end-front end direction and outwardly from the front end, a depth stop axially adjustably mounted at the front end of said housing, thread means located on said depth stop and said housing for direct threaded engagement between said depth stop and said housing for adjustably interconnecting said depth stop to said housing, and an actuating sleeve located on and extending between said depth stop and said housing for adjustably positioning said depth stop in the axial direction relative to said housing, said actuating sleeve being axially displaceable relative to said housing between an adjusting position and an adjusted position, said actuating sleeve being selectively engageable with said housing in the adjusted position so that it does not rotate relative to said housing, means for interconnecting said actuating sleeve with said depth stop in the adjusting and adjusted position so that said actuating sleeve does not rotate relative to said depth stop when said depth stop is axially adjusted relative to said housing and is displaceable in the axial driving direction relative said depth stop, to catch means located on said housing and said actuating sleeve and said catch means in the adjusted position selectively engaging said actuating sleeve and said housing so that said actuating sleeve does not rotate relative to said housing and in the adjusting position where said actuating sleeve is disengaged relative to said housing and is axially displaced from and rotatable along with said depth stop relative to said housing while said depth stop remains in threaded engagement with said housing, said catch means comprises a spring ring fitted on said housing and a shoulder formed on said actuating sleeve and movable over and into locking engagement with said spring ring, and said interconnecting means comprises an axially extending securing pin in axial parallel relation with the driving direction and mounted on said actuating sleeve and engaged with said depth stop and selectively engageable with said housing for blocking rotation of said actuating sleeve relative to said housing.

2. Hand-held device, as set forth in claim 1, wherein said securing pin is secured to the inside surface of said actuating sleeve.

3. Hand-held device, as set forth in claim 2, wherein a projection extends inwardly from the inside surface of said actuating sleeve and said securing pin extends axially through said projection so that the opposite ends of said pin project outwardly from each of the opposite sides of said projection and said projection fastens said securing pin in place.

4. Hand-held device, as set forth in claim 3, wherein said depth stop has a borehole formed therein extending in the axial driving direction, and one of said ends of said securing pin is slidably engageable in said borehole for interengaging said actuating sleeve and said depth stop.

5. Hand-held device, as set forth in claim 3, wherein said housing having recesses formed therein spaced apart in the circumferential direction extending around the axial driving direction, and one of said ends of said securing pin is engageable in said recesses in said housing for fixing said actuating sleeve against rotation relative to said housing.

6. Hand-held device, as set forth in claim 1, wherein rotation locking means are provided on said housing and said depth stop for interrupting the rotation of said depth stop after said depth stop completely traverses its path of adjustment in the direction toward said housing.

7. Hand-held device, as set forth in claim 6, wherein said rotation locking means comprises an extension projecting in the axial driving direction from a part of said housing and a cam formed on the rear end of said depth stop facing toward said housing so that the rotation lock is effective when said cam engages said extension.

8. Hand-held device, as set forth in claim 1, wherein said depth stop comprises a threaded bush and a stop sleeve detachably connected together.

9. Hand-held device, as set forth in claim 8, including a bayonet connection for detachably connecting said threaded bush to said stop sleeve.

10. Hand-held device, as set forth in claim 1, wherein said housing includes an extension extending in the axial driving direction into said depth stop, a locking ring fixed on said housing extension, said locking ring having a plurality of circumferentially spaced recesses therein, said securing pin is selectively engageable in said recesses for preventing rotation between said actuating sleeve and said housing.

* * * * *